US006954129B2

(12) United States Patent
Buswell

(10) Patent No.: US 6,954,129 B2
(45) Date of Patent: Oct. 11, 2005

(54) WIRE CORE INDUCTIVE DEVICES HAVING A FLUX COUPLING STRUCTURE AND METHODS OF MAKING THE SAME

(76) Inventor: Harrie R. Buswell, 132 Lorraine Ct., Berea, KY (US) 40403

( * ) Notice: Subject to any disclaimer, the term of this patent is extended or adjusted under 35 U.S.C. 154(b) by 53 days.

(21) Appl. No.: 10/470,005

(22) PCT Filed: Jan. 23, 2002

(86) PCT No.: PCT/US02/01663

§ 371 (c)(1),
(2), (4) Date: Jul. 23, 2003

(87) PCT Pub. No.: WO02/059918

PCT Pub. Date: Aug. 1, 2002

(65) Prior Publication Data

US 2004/0061586 A1 Apr. 1, 2004

Related U.S. Application Data

(60) Provisional application No. 60/263,636, filed on Jan. 23, 2001.

(51) Int. Cl.[7] ..... H01F 27/02

(52) U.S. Cl. ..... 336/83; 336/223; 336/205; 336/229; 29/606

(58) Field of Search ..... 336/83, 233, 234, 336/60, 205, 229; 29/602.1, 606

(56) References Cited

U.S. PATENT DOCUMENTS

| | | | | | |
|---|---|---|---|---|---|
| 2,179,661 | A | * | 11/1939 | Jones | 336/58 |
| 3,304,599 | A | | 2/1967 | Nordin | 29/155.57 |
| 3,350,670 | A | * | 10/1967 | Strauch | 336/90 |
| 3,720,897 | A | | 3/1973 | Feather et al. | 336/60 |
| 4,035,751 | A | * | 7/1977 | Walthew | 336/60 |
| 6,239,681 | B1 | | 5/2001 | Buswell | 336/83 |
| 6,268,786 | B1 | | 7/2001 | Buswell | 336/83 |

* cited by examiner

*Primary Examiner*—Anh Mai
(74) *Attorney, Agent, or Firm*—Miles & Stockbridge P.C.

(57) ABSTRACT

An inductive device (10) comprises a magnetic core (16) including a portion of a plurality of wires (18), an electric winding (20) extending around said magnetic core, with one or more of the plurality of wires (18) at least partially encircling the electric winding (20) and having first and second end portions (26) arranged so as to form a gap (24) therebetween, and a flux coupling structure (28) disposed in a vicinity of the gap (24) so as to enhance coupling of magnetic flux between the first and second end portions (26).

40 Claims, 4 Drawing Sheets

WIRE CORE INDUCTIVE DEVICES HAVING A FLUX COUPLING STRUCTURE AND METHODS OF MAKING THE SAME

CROSS REFERENCE TO RELATED APPLICATIONS

This application claims the benefit of provisional Application No. 60/263,636, filed on Jan. 23, 2001, which is incorporated herein by reference.

BACKGROUND OF THE INVENTION

1. Field of the Invention

The present invention relates to the field of inductive devices, and more particularly to wire core inductive devices such as transformers, chokes, coils, ballasts, and the like.

2. Description of Related Art

It is common for low frequency application transformers and other inductive devices to be made up on a magnetic core comprising a plurality of sheets of steel, the sheets being die cut and stacked to create a desired thickness of the core. For many years the thickness (thus number of necessary pieces) of the stampings has been determined by a strict set of constraints, e.g. magnitude of eddy currents versus number of necessary pieces. The individual sheets of selected thickness are generally oxide-coated, varnished or otherwise electrically insulated from one another in order to reduce/minimize eddy currents in the magnetic core.

The present inventor has developed wire core inductive devices such as transformers, chokes, coils, ballasts, and the like having a magnetic core including a portion of a plurality of wires rather than the conventional sheets of steel. The end portions of the plurality of wires extend around the electrical windings and are arranged to substantially complete a magnetic circuit or flux path. These devices and related methods of manufacturing these devices are set forth in detail in U.S. Pat. Nos. 6,239,681 and 6,268,786, which are incorporated herein by reference.

One particular aspect of these wire core devices is the use of a band or the like to secure the end portions of the plurality of wires in an overlapping or an end-to-end substantially abutting arrangement. Although these arrangements are sufficient to complete a magnetic circuit or flux path, the reluctance of the path is highly dependent upon an effective gap that may exist between the end portions of the wires. The effective gap is generally considered to be an air gap in most applications. The effective gap present in the wire core inductive devices of the above-identified patents, as well as in conventional inductive devices, serves the useful purpose of reducing the negative effects of in-rush currents. It is desirous to be able to control the effective gap so as to provide suitable gap dimensions in a wide range of applications such that the gap can range from an appreciable and dominating factor in the magnetic circuit to an essentially zero gap condition.

SUMMARY OF THE INVENTION

The present invention provides an improved wire core inductive device having a flux coupling structure that reduces the amount of an effective gap between the wire end portions, thus enhancing the coupling of magnetic flux across the gap and improving the overall efficiency of the device.

This invention provides a wire core inductive device wherein the effective gap is selectively determined by the arrangement and positioning of a flux coupling structure relative to a gap between end portions of the wires.

This invention provides an inductive device having a magnetic core including a portion of a plurality of wires, an electric winding extending around the magnetic core, with one or more of the plurality of wires at least partially encircling the electric winding and having first and second end portions arranged so as to form a gap therebetween, and a flux coupling structure disposed in a vicinity of (in or adjacent to) the gap so as to enhance the coupling of magnetic flux between the first and second end portions. Such an inductive device provides a cost effective way to control the effective gap.

This invention also provides a method for making an inductive device, including the steps of providing a magnetic core including a portion of a plurality of wires, arranging an electric winding around the magnetic core, configuring one or more of the plurality of wires so as to at least partially encircle the electric winding and form a gap between the first and second end portions of the one or more wires and providing a flux coupling structure in a vicinity of (in or adjacent to) the gap so as to enhance the coupling of magnetic flux between the first and second end portions.

In a preferred embodiment of this invention, electric windings are either wound directly onto a magnetic core formed of a portion of a plurality of wires, or are wound separately and slipped over an end of the core. The end portions of the plurality of wires extend around the electric windings so as to complete a magnetic circuit and form a gap between the first and second end portions of the wires. The wires formed in this manner provide a shield that substantially contains electromagnetic fields emanating from the device and that reduces the intrusion of electromagnetic fields from external sources. It will be appreciated that a flux gap will exist between the first and second wire end portions even if the end portions are abutted with one another (i.e., end-to-end) or overlapped with one another. A flux coupling structure is disposed in a vicinity of the gap and the first and second end portions of the wires, thereby enhancing the magnetic flux path between the end portions of the plurality of wires.

In a preferred embodiment, the lengths of the plurality of wires, which form the magnetic core, are selected such that the gap formed between the end portions of the wires is of a predetermined size.

In another preferred embodiment, the gap is formed and/or sized by trimming or machining end portions of the plurality of wires. Trimming or machining the wires provides common mating faces for the flux coupling structure that in various embodiments is configured to be disposed within the gap.

In accordance with a preferred embodiment of the present invention, the flux coupling structure is disposed within the gap. The flux coupling structure significantly reduces the effective gap between the first and second end portions of the wires and thus reduces the magnetic reluctance between the end portions as compared to simply overlapping or abutting the end portions of the wires. Without the flux coupling structure, the effective gap would correspond to the size of the gap between the end portions of the wires. Advantageously and in accordance with the present invention, the effective gap between the end portions of the wires is reduced with the flux coupling structure reducing the effect of the gap on the magnetic flux and thus improving the overall efficiency of the inductive device.

In various embodiments the flux coupling structure includes a plurality of wire segments. The wire segments may be disposed in the gap in bundles or groups. Further, the wire segments may be embedded in an adhesive or other matrix material. The matrix may include a resistive or insulating filler material and/or may include magnetic particles such as a magnetically active powder, slurry so as to further reduce the effective gap.

In a preferred embodiment of the present invention, the inductive device is a toroidal inductive device. Exemplary toroidal inductive devices are disclosed in provisional Application No. 60/263,638, filed on Jan. 23, 2001, and copending PCT Application filed on Jan. 23, 2002, entitled Toroidal Inductive Devices and Method of Making the Same, both filed by the present inventor and incorporated herein by reference. These applications disclose toroidal inductive devices that include a plurality of discrete magnetic components that embrace an electric component having a toroidal shape so as to complete a magnetic flux path that at least partially passes through the electric component. In accordance with this invention, a flux coupling structure is disposed in a vicinity of the gap formed by the plurality of magnetic components.

BRIEF DESCRIPTION OF THE DRAWINGS

The foregoing and other features and advantages of this invention will be more fully appreciated from the following detailed description of the preferred embodiments with reference to the accompanying drawings, wherein.

DETAILED DESCRIPTION OF THE PREFERRED EMBODIMENT

Figure 1:
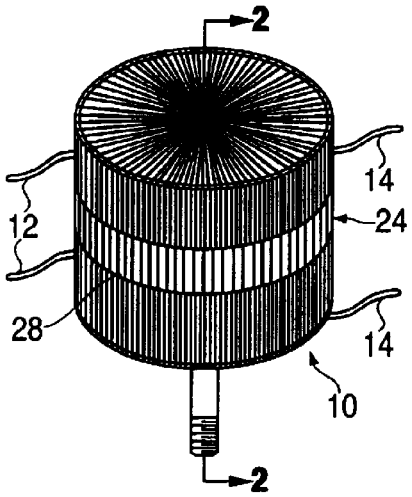
FIG. 1 is a perspective view of an inductive according to a preferred embodiment of the present invention.

FIG. 1 shows an inductive device 10 according to a preferred embodiment of this invention. In this embodiment, the inductive device 10 is a transformer. However, it should be appreciated that the principles of this invention are applicable to a variety of inductive devices, such as, but not limited to: transformers and coils (chokes, reactors, etc.) both of types that utilize core saturation (saturable transformers, magnetic amplifiers, saturable reactors, swinging chokes, etc.) and those that do not, as well as AC applications of solenoids, relays, contactors, and linear and rotary inductive devices.

The inductive device 10 includes leads 12 for connecting a power source (not shown) to a primary winding of the inductive device 10. The inductive device 10 also includes leads 14 for connecting a secondary winding to a load (not shown). Those skilled in the art will realize that the designation of the primary and secondary windings is somewhat arbitrary, and that one may use the leads 14 for connection to the primary winding, and the leads 12 for connection to the secondary winding. The designations of "primary" and "secondary" are therefore used herein as a convenience, and it should be understood that the windings are reversible.

Figure 2:
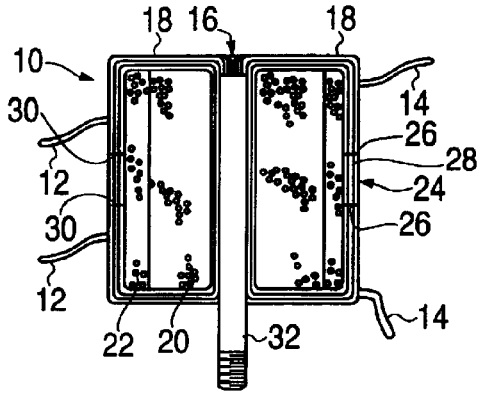
FIG. 2 is a cross-sectional view taken along the line 2—2 of FIG. 1.

FIG. 2 is a cross-sectional view of the inductive device 10 taken along the line 2—2 in FIG. 1. The inductive device 10 includes a magnetic core 16 formed of a portion of a plurality of wires 18. Electric windings 20 and 22 extend around the magnetic core 16. In this embodiment, the electric winding 22 also extend portions around the electric winding 20.

The plurality of wires 18 substantially encircles the windings 20 and 22 so as to complete a magnetic circuit. The plurality of wires 18 are arranged to form a gap 24 between the end portions 26 of the wires 18. The leads 12 and 14 pass between the plurality of wires 18 to connect to the electric windings 20 and 22, respectively.

The inductive device 10 also includes a flux coupling structure 28 (to be described later) disposed in a vicinity of the gap 24, so as to enhance coupling of the magnetic flux between the end portions 26. In this embodiment, the flux coupling structure 28 is disposed in the gap 24.

The lengths of the plurality of wires 18 are pre-selected such that the gap 24 is of a predetermined width between the end portions 26. In an alternative embodiment of the present invention, the gap 24 is formed and/or its width is determined by trimming or machining the plurality of wires 18. Machining the wire end portions provides a more consistently sized gap 24. Advantageously, trimming or machining the end portions 26 provides more consistent mating end faces for abutting with end faces 30 of the flux coupling structure 28.

In this embodiment, the flux coupling structure 28 is slightly oversized relative to the width of the gap 24, so as to maintain constant pressure between the end portions 26 of the wires 18 and end faces 30 of the flux coupling structure 28. The constant pressure will hold the flux coupling structure 28 in place as well as further reduce the effective gap. However, it should be appreciated that in other embodiments, the flux coupling structure may be of a length that is less than, greater than, or the same as the width of the gap 24. The flux coupling structure 28 is preferably made of or includes a material that has a higher magnetic permeability and/or higher saturation level than the material used for the plurality of wires 18.

The flux coupling structure 28 significantly reduces the effective gap between the end portions 26 of the plurality of wires 18 as compared to overlapping or end-to-end abutting arrangements. As indicated above, reducing the effective gap, reduces the effect of the effective gap on the magnetic flux, thus improving the overall efficiency of the inductive device 10. Further, by controlling the size and arrangement of the flux coupling structure relative to the gap, the effective gap can be controlled as desired.

In this exemplary embodiment, the flux coupling structure 28 includes a plurality of wire segments. However, the flux coupling structure may be of any form so long as it enhances coupling of flux between the end portions of the wires. For example, it may take the form of a plate, a snap ring, an annular band, a matrix containing magnetic material or any other suitable form (including combinations of the foregoing). When the flux coupling structure includes a matrix containing magnetic particles, it may be desirable to energize the winding with a dc current to orient the particles prior to hardening of the matrix material.

Figure 3:
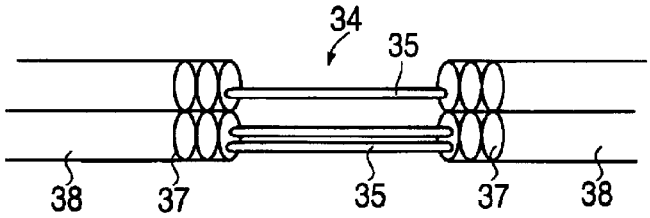
FIG. 3 is a partial perspective view of an exemplary embodiment of a flux coupling structure according to the invention.

In the arrangement shown in FIG. 3, a flux coupling structure 34 includes magnetic wires that are smaller in diameter than the plurality of wires 38 that form the magnetic core. More specifically, the flux coupling structure 34 includes a plurality of wires 35 disposed in a gap between end portions 37 of the plurality of wires 38. The diameter of the wires 35 is substantially smaller than the diameter of the wires 38. With the wires 35 being smaller in diameter than the magnetic core wires 38, the wires 35 may be randomly inserted and yet still insure a high degree of continuity between the end portions. Precise placement and arrangement of the wires 35 is not necessary. Thus each end 37 of the wires 38 will generally have at least one of the wires 35 contacting it, and often will be contacted by more than one wire 35. Utilizing smaller diameter wires for the flux coupling structure thus provides a cost-effective way to provide substantial coupling of the flux between the end portions of the plurality of wires. It should be appreciated that the wires 35 may also be embedded in a matrix as previously described.

The inductive device 10 also includes a mounting post 32, as described in the aforementioned incorporated U.S. Pat. Nos. 6,239,681 and 6,268,786.

Figure 4:
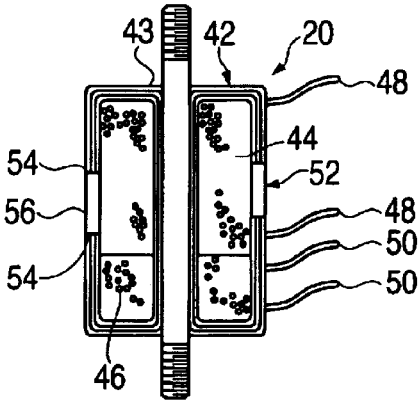
FIG. 4 is a cross-sectional view similar to FIG. 2, but showing an alternative embodiment of an inductive device according to this invention.

FIG. 4 is a cross-sectional view similar to FIG. 2, but shows an inductive device 40 according to an alternative embodiment of the present invention. The inductive device 40 is similar to the inductive device 10 in that it includes a magnetic core 42 formed of a portion of a plurality of wires 43 and electrical windings 44 and 46, which extend around the magnetic core 42. However, the windings are arranged axially adjacent to each other rather than concentrically. The leads 48 and 50 connect to the windings 44 and 46, respectively. Similar to the inductive device 10, a gap 52 is formed between end portions 54 of the plurality of wires 43. A flux coupling structure 56 is disposed in a vicinity of the gap 52. The flux coupling structure 56, which may be constructed as previously described, enhances the coupling of the magnetic flux across the gap 52.

Figure 5:
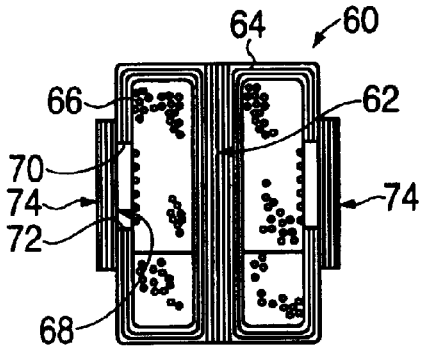
FIG. 5 is a cross-sectional view of another embodiment of an inductive device according to this invention.

FIG. 5 is a cross-sectional view of an inductive device 60 according to another embodiment of this invention. The inductive device 60 includes a magnetic core 62 formed of a portion of a plurality of wires 64, and an electric winding 66. It should be appreciated that the inductive device 60 may include additional electrical windings. The plurality of wires 64 substantially encircle the electric winding 66 so as to complete a magnetic circuit and form a gap 68 between the first and second end portions 70 and 72, respectively of at least one of the plurality of wires 64. The inductive device 60 also includes a flux coupling structure 74 disposed adjacent to the first and second end portions 70 and 72 of the at least one of the plurality of wires 64.

The flux coupling structure 74 is similar to the aforementioned flux coupling structure 28, except that the flux coupling structure 74 has a length greater than the width of the gap 68. The flux coupling structure 74 extend portions over at least the entire width of the gap 68.

Figure 6:
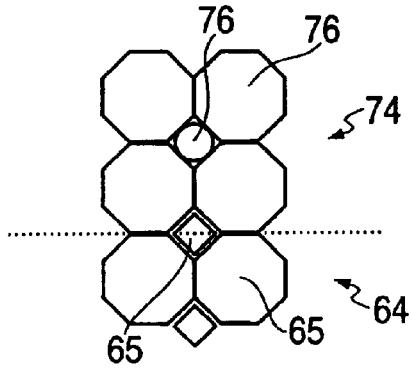
FIG. 6 is a partial cross-sectional end view of the flux coupling structure shown adjacent to the plurality of wires shown in FIG. 5.

FIG. 6 is a partial cross-sectional end view of the flux coupling structure 74 adjacent to the plurality of wires 64. The flux coupling structure 74 includes a plurality of wires 76. However, the flux coupling structure 74 may be a single solid piece, or other form or shapes as discussed above regarding the flux coupling structure 28.

As shown in FIG. 6, the wires 76 of the flux coupling structure 74 include wires that have different cross-sectional shapes to increase the density of the flux coupling structure, thereby enhancing its magnetic properties. However, it should be appreciated that the wires 76 may all have the same cross-sectional shape.

The plurality of wires 64 also includes wires 65 that have different cross-sectional shapes to increase the density of the magnetic core and thereby enhance its magnetic properties. However, the plurality of wires 64 may all have the same cross-sectional shape.

Use of different cross-sectional shapes for both the plurality of wires 64 and the wires 76 of the flux coupling structure 74 provides an effective way of controlling magnetic properties of the inductive device and also allows for interlocking of the flux coupling structure and the plurality of wires, as shown in FIG. 6.

The flux coupling structure 74 may also be affixed or attached to the inductive device by a variety of means, including but not limited to a band or an adhesive, such as epoxy. The adhesive may include magnetic elements to further increase the magnetic flux.

Figure 7:
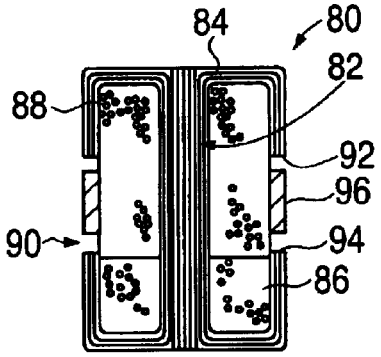
FIGS. 7 and 8 are cross-sectional views of inductive devices according to further embodiments of this invention.

FIG. 7 is a cross-sectional view of an inductive device 80 according to another embodiment of this invention. The inductive device 80 is similar to the inductive device 60 in that it includes a magnetic core 82 formed of a portion of a plurality of wires 84, and electric windings 86 and 88 extending around the core 82. The plurality of wires 84 encircle the electric windings 86 and 88 so as to complete a magnetic circuit and form a gap 90 between the first and second end portions 92 and 94 of the wires 84. The inductive device 80 also includes a flux coupling structure 96 disposed adjacent to the end portions 92 and 94 so as to enhance the flux path between the end portions 92 and 94.

The flux coupling structure 96 is similar to the aforementioned flux coupling structure 74, except that the flux coupling structure 96 has a length that is less than the width of the gap 90. At least a portion of the flux coupling structure 96 is disposed in the gap 90.

The flux coupling structure 96 may include a plurality of wires, or it may be of other suitable form as described above regarding the flux coupling structure 28.

The flux coupling structure 96 may be affixed or attached to the inductive device by a variety of means including, but not limited to, a band or an adhesive, such as epoxy. The adhesive may include magnetic elements to further increase the magnetic flux.

Figure 8:
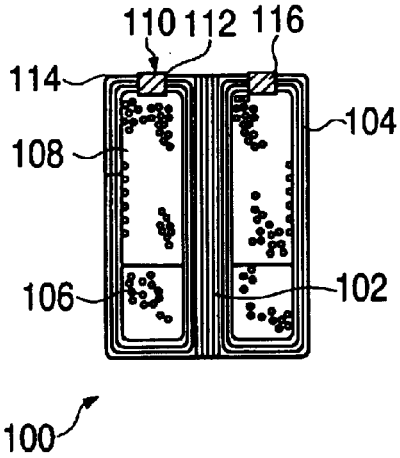

FIG. 8, is a cross-sectional view of an inductive device 100 according to still another embodiment of the invention. The inductive device 100 is similar to the aforementioned inductive device 60 in that it includes a magnetic core 102 formed of a portion of a plurality of wires 104, and electric windings 106 and 108 that extend around the core 102. The plurality of wires 104 substantially encircle the electric windings 106 and 108 so as to complete a magnetic circuit and form a gap 110 between the first and second end portions 112 and 114, respectively, of the plurality of wires 104.

In this embodiment, the gap 110 is positioned at one end of the inductive device 100. However, gap may be, in this and other embodiments, positioned at any suitable location of the inductive device, including within the magnetic core.

The inductive device 100 also includes a flux coupling structure 116 disposed adjacent to the end portions 112 and 114 of the wires 104 and substantially in the gap 110 so as to enhance the coupling of flux between the end portions 112 and 114. The flux coupling structure 116 may be a plurality of wires, or it may be of other form as discussed above regarding the flux coupling structure 28. The flux coupling structure 116 may be affixed or attached to the inductive device by a variety of means, including but not limited to a band or an adhesive, such as epoxy. The adhesive may include elements to further increase the magnetic flux.

Figure 9:
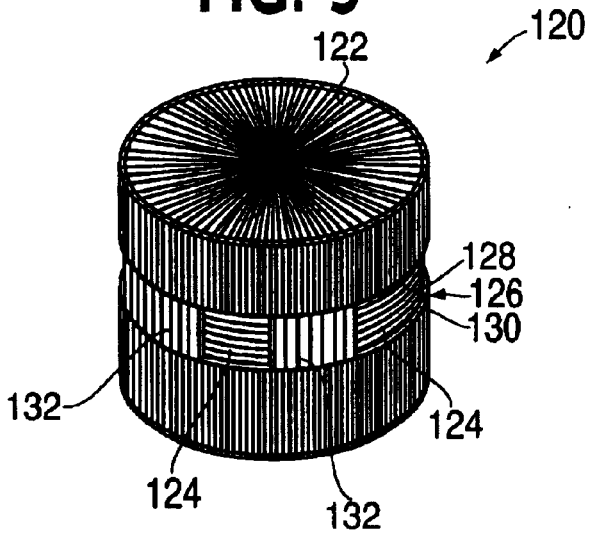
FIG. 9 is a perspective view of an inductive device according to another embodiment of this invention.

FIG. 9 is a perspective view of an inductive device 120 according to another embodiment of this invention. The inductive device 120 is similar to the aforementioned embodiments in that it includes a magnetic core (not shown), formed of a portion of a plurality of wires 122, and at least one electric winding 124 extending around the core. The plurality of wires 122 substantially encircle the electric winding 124 so as to complete a magnetic circuit and form a gap 126 between the first and second end portions 128 and 130, respectively, of the wires 122.

The inductive device 120 also includes a plurality of flux coupling structures 132 disposed in the vicinity of the first and second end portions 128 and 130 of the wires 122 to enhance the flux path between the end portions 128 and 130.

The flux coupling structure 132 are disposed in the gap 126. In this embodiment, the flux coupling structures 132 are circumferentially spaced from one another.

Each of the flux coupling structures 132 includes a plurality of wires. However, it should be appreciated that the flux coupling structures 132 may, in other embodiments, be other forms as discussed above for the flux coupling structure 28.

It should be appreciated that the flux coupling structure 132 may be secured to the inductive device by a variety of means, including but not limited to a band or an adhesive, such as epoxy. The adhesive may include elements to further increase the magnetic flux.

Figure 10:
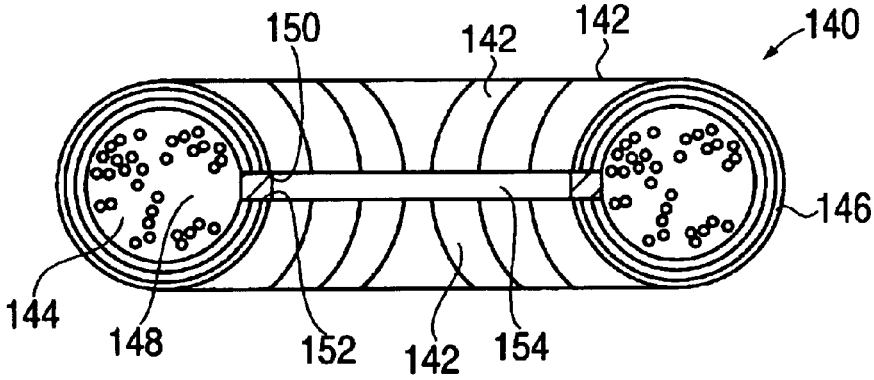
FIG. 10 is a cross-sectional view of an inductive device according to still another embodiment of this invention.

FIG. 10 is a perspective view of an inductive device 140, according to still another embodiment of the invention. The inductive device 140 has a generally toroidal shape and includes a plurality of discrete magnetic components 142 and at least one electrical winding 144, which also has a generally toroidal shape. Leads, not shown, are connected to the electrical winding 144.

The inductive device 140 is similar to the toroidal inductive devices disclosed in the aforementioned provisional Application No. 60/263,638, filed on Jan. 23, 2001, and PCT Application filed on Jan. 23, 2002, entitled Toroidal Inductive Devices and Method of Making the Same.

The plurality of magnetic components 142 includes a plurality of wires 146. The wires 146 substantially encircle the generally toroidal shaped electrical winding 144, so as to complete a magnetic circuit and form a gap 148 between first end portions 150 and second end portions 150 and 152 of the wires 146. A flux coupling structure 154 is disposed in the vicinity of the gap 148 (here, within the gap) to enhance the flux path between the end portion 150 and 152.

The flux coupling structure 154 includes a plurality of wires, similar to the aforementioned flux coupling structure 28. The wires of the flux coupling structure 154 may include wires that have different cross-sectional shapes, as previously discussed, or they may all have the same cross-sectional shape.

Figure 11:
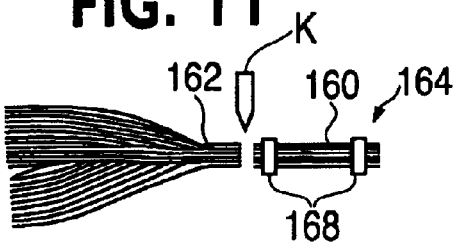
FIG. 11 is an illustration for explaining a method, including forming a magnetic core by gathering a plurality of wires pulled from a creel to form a bundle, securing the wires with bands, and severing the bundled wires, according to a preferred embodiment of this invention.

The use of a plurality of wires to form a magnetic core yields an efficient method for making an inductive device as set forth in the aforementioned patents. In accordance with a preferred embodiment of a method according to this invention, FIG. 11 shows a step of providing a magnetic core 160, which includes gathering a plurality of wires 162 from a creel (not shown) to form a bundle 164, and severing the bundle at a predetermined length with a knife K or the like. The resulting magnetic core 160 is initially held together by bands 168 or the like. It will be recognized that the plurality of wires 162 pulled from the creel may all be the same diameter or may be a combination of different diameters. Furthermore, the plurality of wires 162 may all have the same cross-sectional shape or may be a combination of different cross-sectional shapes. As noted above, the use of different diameter wires and/or cross-sectional shapes allows for a more dense packing of the magnetic core 160, thereby improving its magnetic characteristics.

Figure 12:
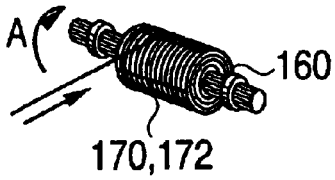
FIG. 12 is an illustration for explaining a method, including forming an electric winding directly on a magnetic core, according to a preferred embodiment of this invention.

In accordance with the preferred method, electric windings 170 and 172 are placed on the magnetic core 160. The electric windings 170 and 172 may be formed by winding a coil of wire on a spindle for slipping over the magnetic core 160. Alternatively, the electric windings 170 and 172 may be wound directly on the magnetic core 160, as indicated by arrow A in FIG. 12. Advantageously, this direct placement of the electric windings 170 and 172 onto the magnetic core 160 provides a more efficient, and thus more economical method of manufacturing by eliminating steps in the prior art manufacturing methods.

By winding the electric windings 170 and 172 directly on the magnetic core 160, the electric windings assist in binding the core. This offers several mechanical and electrical advantages, including tighter magneto-electric coupling and reduced vibrational noise from the core.

Figure 13:
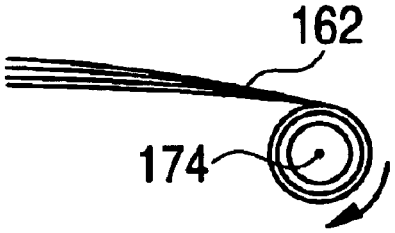
FIGS. 13 and 14 are illustrations for explaining an alternative embodiment of a method, including forming a magnetic core by winding one or a plurality of wires on a spindle and severing the wound wires to form the core, according to this invention.
Figure 14:
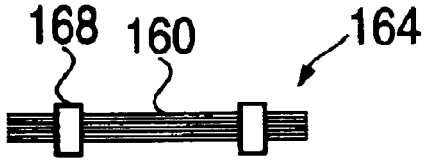

FIGS. 13 and 14 illustrate an alternative method for forming a bundle of wires, a portion of which may be used as a magnetic core in accordance with the present invention. A magnetic core 160 is formed by feeding one wire or a plurality of wires 162 to a winder 174. The plurality of wires may, in various embodiments, include wires having different diameters, the wires being geometrically sized and arranged to be densely packed. The plurality of wires are removed from the winder 174, severed at a predetermined length to form a bundle 164, and straightened as shown in FIG. 14. By appropriately deforming the wound wires before severing, the end portions will be substantially square. As in the method shown in FIG. 11, bands 168 or the like hold the bundle of wires 164 together, thus forming the magnetic core 160.

Figure 15:
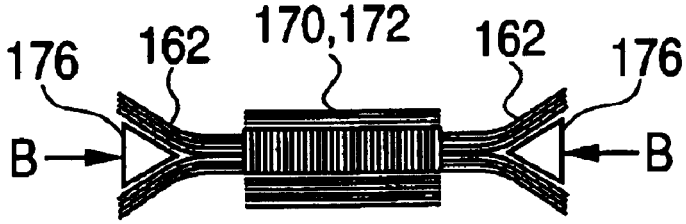
FIG. 15 is a view for explaining a technique of forming the plurality of wires over the electric windings in a preferred embodiment of the present invention.

With the electric windings 170 and 172 in place around the magnetic core 160, plurality of wires 162 are preferably configured to substantially encircle the windings. FIG. 15 illustrates one exemplary technique for use in arranging the plurality of wires 162 around the windings. The plurality of wires 162 are initially deformed by moving cones 176 into the bundle end portions as indicated by arrows B (or moving a single cone into one end and then the other) to spread the wires generally radially. Any conventional means may then be used to finish configuring the wires 162 around the electric windings 170 and 172, as generally shown in FIG. 1.

Those skilled in the art will recognize that the magnetic core of an inductive device preferably forms a complete magnetic circuit or flux path. The end portions of the plurality of wires 162 extending from the magnetic core 160 are formed around the electric windings 170 and 172 leaving a gap similar to the gap shown in FIGS. 1 and 2. The size of the gap is determined by the placement and the lengths of the plurality of wires 162. A flux coupling structure (not shown) is provided in the vicinity of the gap to enhance the magnetic flux path, similar to exemplary arrangement of the flux coupling structure 28 shown in FIGS. 1 and 2. In a preferred embodiment of a method according to this invention, the flux coupling structure is inserted in the gap.

In an alternative embodiment, the gap is formed by trimming or machining the end portions of the plurality of wires 162 in order to provide a more consistently sized gap between the end faces of the end portions of the wires 162.

The plurality of wires 162 of the completed device notably form an electromagnetic shield. The may therefore be used in electrically noisy environments without adversely affecting or being adversely affected by surrounding components.

It will be understood that the present invention provides a highly efficient method for making an inductive device and a highly efficient inductive device having a flux coupling structure that enhances flux coupling across a gap in the magnetic circuit.

It should be appreciated that the shape of the inductive device according to this invention is not limited to the generally cylindrical shape of the illustrative embodiments. An inductive device according to this invention may be of any shape suitable for a specific application.

The foregoing descriptions of preferred embodiments of the invention have been presented for purposes of illustration. They are not intended to be exhaustive or to limit the invention to the precise forms disclosed. Obvious modifications, variations or combination of embodiments are possible in light of the above teachings. The preferred embodiments were chosen and described to provide an illustration of the principles of the invention and its practical application to thereby enable one of ordinary skill in the art to utilize the invention in various embodiments and with various modifications as may be appropriate to the particular use contemplated. Various changes may be made without departing from the spirit and scope of this invention.

What is claimed is:

1. An inductive device comprising:

a magnetic core including a portion of a plurality of wires;

an electric winding extending around said magnetic core, with one or more of said plurality of wires at least partially encircling said electric winding and having first and second end portions arranged so as to form a gap therebetween; and a flux coupling structure disposed in a vicinity of said gap so as to enhance coupling of magnetic flux between said first and second end portions.

2. An inductive device as recited in claim 1, wherein said at least one flux coupling structure is disposed in said gap.

3. An inductive device as recited in claim 1, wherein said flux coupling structure is disposed adjacent said gap.

4. An inductive device as recited in claim 1, wherein said flux coupling structure spans a width of said gap.

5. An inductive device as recited in claim 4, wherein said flux coupling structure is disposed in said gap.

6. An inductive device as recited in claim 5, wherein said flux coupling structure is press fitted in said gap.

7. An inductive device as recited in claim 4, wherein said flux coupling structure is disposed adjacent to said gap.

8. An inductive device as recited in claim 4, wherein said flux coupling structure is in contact with said first and second end portions.

9. An inductive device as recited in claim 1, wherein said flux coupling structure occupies only part of a width of said gap.

10. An inductive device as recited in claim 1, wherein said gap is formed between opposed end faces of first and second end portions.

11. An inductive device as recited in claim 10, wherein said end faces are spaced from one another.

12. An inductive device as recited in claim 10, wherein said end faces are abutted with one another.

13. An inductive device as recited in claim 1, wherein said end portions are overlapped with one another.

14. An inductive device as recited in claim 1, wherein said flux coupling structure is a band.

15. An inductive device as recited in claim 1, wherein said flux coupling structure includes at least one wire.

16. An inductive device as recited in claim 1, wherein said flux coupling structure includes a plate.

17. An inductive device as recited in claim 16, wherein said flux coupling structure is annular.

18. An inductive device as recited in claim 1, wherein said flux coupling structure includes a plurality of wire segments.

19. An inductive device as recited in claim 18, wherein said plurality of wire segments includes wire segments of different cross-sectional shapes.

20. An inductive device as recited in claim 18, wherein said plurality of wire segments includes wire segments of different diameters.

21. An inductive device as recited in claim 18, wherein said plurality of wire segments are embedded in a matrix.

22. An inductive device as recited in claim 21, wherein said matrix includes magnetic particles.

23. An inductive device as recited in claim 1, wherein said flux coupling structure includes a matrix containing magnetic particles.

24. An inductive device as recited in claim 1, wherein said gap is formed at an end of said inductive device.

25. An inductive device as recited in claim 1, wherein said plurality of wires include wires of different diameters arranged to increase the density of said magnetic core.

26. An inductive device as recited in claim 1, wherein said plurality of wires substantially envelop said electric winding to provide shielding from electromagnetic fields.

27. An inductive device as recited in claim 1, wherein said first and second end portions of said at least one wire are secured in place.

28. An inductive device as recited in claim 27, wherein said first and second end portions are secured by said flux coupling structure.

29. An inductive device as recited in claim 1, further comprising a second electric winding extending around said magnetic core and at least partially encircled by said one or more wires.

30. An inductive device as recited in claim 29, wherein said second electric winding is axially displaced from said electric winding.

31. An inductive device as recited in claim 29, wherein said second electric winding is arranged concentrically with said electric winding.

32. An inductive device as recited in claim 1, wherein said electric winding is in direct contact with said magnetic core.

33. A method for making an inductive device, comprising:

providing a magnetic core including a portion of a plurality of wires;

arranging an electric winding around said magnetic core;

configuring one or more of said plurality of wires so as to at least partially encircle said electric winding and form a gap between first and second end portions of said one or more wires; and providing a flux coupling structure in a vicinity of said gap so as to enhance coupling of magnetic flux between said first and second end portions.

34. A method as recited in claim 33, wherein said flux coupling structure is disposed in said gap.

35. A method as recited in claim 33, wherein said flux coupling structure is disposed adjacent said gap.

36. A method as recited in claim 33, wherein said flux coupling structure spans a width of said gap.

37. A method as recited in claim 36, wherein said flux coupling structure is disposed in said gap.

38. A method as recited in claim 37, wherein said flux coupling structure is press fitted in said gap.

39. A method as recited in claim 36, wherein said flux coupling structure is disposed adjacent to said gap.

40. A method as recited in claim 33, wherein said flux coupling structure spans only part of a width of said gap.

* * * * *